US011713225B2

(12) United States Patent
Johns et al.

(10) Patent No.: US 11,713,225 B2
(45) Date of Patent: Aug. 1, 2023

(54) SELF-TAILING WINCH

(71) Applicant: Ronstan International Pty Ltd, Braeside (AU)

(72) Inventors: Derek Johns, Mentone (AU); Albert Mahoney, Frankston North (AU); Niels Bramsen, Børkop (DK)

(73) Assignee: RONSTAN INTERNATIONAL PTY LTD., Braeside (AU)

( * ) Notice: Subject to any disclaimer, the term of this patent is extended or adjusted under 35 U.S.C. 154(b) by 368 days.

(21) Appl. No.: 17/117,305

(22) Filed: Dec. 10, 2020

(65) Prior Publication Data

US 2021/0179399 A1 Jun. 17, 2021

(30) Foreign Application Priority Data

Dec. 11, 2019 (DK) ..... PA 2019 70761

(51) Int. Cl.
*B66D 1/74* (2006.01)

(52) U.S. Cl.
CPC ..... *B66D 1/7494* (2013.01); *B66D 1/7436* (2013.01)

(58) Field of Classification Search
CPC ..... B66D 1/36–39; B66D 1/74–7494; B66D 5/32
See application file for complete search history.

(56) References Cited

U.S. PATENT DOCUMENTS

| | | | | |
|---|---|---|---|---|
| 4,093,185 | A | 6/1978 | Newell | |
| 6,047,955 | A * | 4/2000 | Cavanagh | B66D 1/7431 254/371 |
| 9,938,122 | B2 | 4/2018 | Cazzaro | |
| 2015/0210517 | A1 * | 7/2015 | Nishimoto | B66D 1/7436 254/323 |

FOREIGN PATENT DOCUMENTS

| | | | |
|---|---|---|---|
| EP | 0832842 | A1 | 4/1998 |
| EP | 1362822 | A2 | 11/2003 |
| FR | 2645519 | A1 | 10/1990 |
| GB | 1550175 | A | 8/1979 |

* cited by examiner

*Primary Examiner* — Sang K Kim
*Assistant Examiner* — Nathaniel L Adams
(74) *Attorney, Agent, or Firm* — Cermak Nakajima & McGowan LLP; James Creighton Wray

(57) ABSTRACT

Self-tailing winch with a release function, where said winch comprises:

- a stator body adapted to be fastened on a surface;
- a drum body arranged concentrically and rotatable around said stator body;
- a self-tailing device arranged concentrically to said drum body, where said self-tailing device comprises:
  - two self-tailing jaws defining an opening suitable to receive a rope, sheet or halyard;
  - a self-tailing cover which is rotatable relative to the drum body and the self-tailing jaws;
  - a releasable coupling arranged between the self-tailing cover and the self-tailing jaws, said coupling being able to couple the self-tailing jaws to the drum body and by manipulating the self-tailing cover completely releasing the self-tailing jaws from their engagement with the drum body, allowing the self-tailing jaws to rotate relative to the drum.

15 Claims, 6 Drawing Sheets

SELF-TAILING WINCH

This application claims the benefit of Danish Application No. PA 2019 7i0761 filed Dec. 11, 2019, which is hereby incorporated by reference in its entirety as if fully set forth herein.

FIELD OF THE INVENTION

The present invention relates to a self-tailing winch with a release function as well as a method of operating a self-tailing winch with a release function.

BACKGROUND OF THE INVENTION

A self-tailing winch is a special type of winch which finds applications in a wide variety of technical fields, but especially on sailboats self-tailing winches are widely used.

Winches are typically used in order to pull a rope, wire, sheet or halyard, i.e. to apply tension in the rope, for example when tightening the sails, hoisting the sails etc., but also in other industrial applications winches are widely used, for example by lifting and hauling equipment, trucks, cars and other types of machinery where it is desirable to be able to pull a rope, wire or the like in tension.

Winches may be used to tension ropes, wires, sheets, halyards etc. In the following description all these will be referred to as rope.

The self-tailing winch is a particular type of winch where after the rope or wire has been turned around the drum of the winch a number of times, the free end of the rope or wire is arranged in the self-tailing part of the winch. Typically the self-tailing part of the winch comprises two jaws which are arranged with a mutual distance defining a groove, such that it is possible to insert the rope between the jaws whereby the jaws are able to grip the rope and thereby resist letting out rope while tension is applied to the other end of the rope.

The jaws will typically compress the line axially such that the more tension is applied to the rope, the tighter the fit between the jaws will become and as such the holding power of the jaws will increase.

A further development of these types of self-tailing winches is the provision of movable jaws such that the jaws are urged towards each other for example by a spring whereby various diameters of rope may be fitted in the same winch and held by the self-tailing device due to the jaw's ability to adjust to the various diameters of rope being inserted into the self-tailing device between the jaws.

Examples of such self-tailing winches are disclosed in for example GB1550175.

A further aspect of the self-tailing winches is, that compared to winches without the self-tailing feature it is possible for a single person to continuously operate a winch. With winches without the self-tailing feature it is necessary for one person to apply tension to the free end of the rope after it has been wound a couple of times around the drum of the winch where a second person will be needed to continuously operate the winch to rotate the drum in order to tension the rope. Once the desired tension in the rope has been attained the free end of the rope is usually fastened to a cleat.

With the self-tailing mechanism as described above it is possible to "lock" the rope inbetween the jaws of the self-tailing mechanism such that a single person may continuously operate the winch either by mechanical means such as a handle or by electrical means, for example activating a motor which is quite common in the art of sailboat winches. The biased jaws gripping the rope will retain tension in the rope around the drum of the winch at all times and as such the second person is not needed to keep continuous tension of the rope around the drum and recover the rope as it is pulled by the winch.

As should be understood from the above explanation a winch with a self-tailing device is advantageous when desiring to put tension in a rope, but may cause difficulties when it is desirable to ease off rope from the drum in that the grip of the jaws must be released, for example by pulling the free end of the rope free of the jaws and thereafter manually feed out rope as desired.

In some applications the tension in the rope is quite considerable and as such it is difficult to feed-out the rope smoothly or be able to handle it manually in a safe and satisfactory manner For this purpose it is desirable to incorporate a controllable release function into the winch construction. An example of this is known from U.S. Pat. No. 9,938,122. In this prior art winch a knob is arranged at the top of the winch such that by operating the knob it is possible to force the griping jaws apart in a controllable manner, such that the jaw's gripping action on the rope or line in the actual direction is lessened whereby it is possible to feed-out rope in a more or less controllable manner In order to lessen the tension in the jaws U.S. Pat. No. 9,938,122 comprises an internal construction such that by twisting the knob a pin in a specially designed aperture will cause the upper jaw to lift slightly with respect to the lower jaw, thereby opening or lessening the grip on the rope. In this manner it is possible to lessen the tension on the rope in the self-tailing device and when feeding out the rope the rope will slide between the jaws and thereby cause wear and tear in the rope. The jaws are both coupled to the drum as this is the normal construction in the business of self-tailing devices that the jaws are fixed and connected to the drum, in order to maintain tension. If the jaws are not fixed, when tension is applied to the end of the rope or the drum is being rotated, there is a risk of the drum rotating at a different speed than the jaws whereby either the rope will come loose from the jaws, or it will become so tight it is impossible to rotate either drum or jaws without breaking either.

In the other prior art document GB1550175 mentioned above the self-tailing mechanism is arranged such that it is possible for one of the jaws to rotate freely of the drum. The convention behind this being that in order to pull the rope properly onto the drum it is necessary that the self-tailing device must move with the drum. The construction in GB1550175 provides constructional simplification such that it is easier to construct and assemble the winch, particularly with respect to the line guide which is provided in order to ease the transition of the rope to be tensioned around the drum when it enters the self-tailing device part of the drum.

A further example is disclosed in FR2645519 presenting a self-clamping capstan with differential drive for the self-clamping head comprises at least one fixed stator, supporting a drum and a self-clamping/self-tailing head which are mounted so that they can rotate on the stator, being rotationally driven from a central vertical input shaft, the self-clamping/self-tailing head comprising a lower conical jaw and an upper conical jaw which are fixed with respect to one another and rotationally driven with the aid of a differential reduction gear which distributes the torque received from the input shaft after amplification, unequally between the drum which receives a higher torque and the self-clamping/self-tailing head which receives a lower torque, thus allowing automatic adjustment of the rotational speed of the head as a function of the diameter and of the nature of the sheets used. This is practical when the ropes' diameter does not enter between the jaws to an extend whereby the diameter of the rope between the jaws around the self-tailing head and the rope around the drum are not the same. The capstan therefore compensates for this unevenness. Furthermore, due to a gear mechanism incorporated in the head of the capstan, the input from the input shaft may be selected for direct drive.

OBJCECT OF THE INVENTION

It is therefore an object of the invention to provide a self-tailing winch with a release mechanism which in addition to being easy to manipulate and thereby control the feed out of rope, also does not cause excessive wear on the rope.

DESCRIPTION OF THE INVENTION

The present invention provides a self-tailing winch with a release function which is particular in that the winch comprises a stator body adapted to be fastened on a surface;

a drum body arranged concentrically and rotatable around said stator body;

a self-tailing device arranged concentrically to said drum body, where said self-tailing device comprises:

two self-tailing jaws defining an opening suitable to receive a rope, sheet or halyard;

a self-tailing cover which is rotatable relative to the drum body and the self-tailing jaws;

a releasable coupling arranged between the self-tailing cover and the self-tailing jaws, said coupling being able to couple the self-tailing jaws to the drum body and by manipulating the self-tailing cover completely releasing the self-tailing jaws from their engagement with the drum body, allowing the self-tailing jaws to rotate relative to the drum.

In this construction the releasable coupling arranged between the self-tailing cover and the self-tailing jaws ensures that the self-tailing jaws may rotate completely independently of the drum and as such by manipulating the coupling by twisting the self-tailing cover the self-tailing jaws may be liberated from their engagement with the drum and as such rotate completely freely of the drum.

This provides an easy feed-out of line in that it is possible to lessen the friction between the rope and the drum very gradually and at the same time the wear and tear of the rope in the gripping jaws is avoided. For many sailboats sheets will typically be tensioned to a more or less standard position such that it is always the same part of the sheet which will be gripped by the self-tailing devices and as such tear and wear on the sheet will occur in certain positions. This means that the sheets will have to be replaced long before the entire sheet is worn out due to the wear and tear in certain specific places. One way of avoiding this is naturally to at regular intervals invert the sheet end-for-end or use a self-tailing device according to the present invention.

In a further advantageous embodiment of the invention the self-tailing jaws are provided with a surface facing towards the rotation axis around which the drum and jaws rotate, and where indentations are provided in said surface, and where the drum on a part of the drum being covered by the self-tailing jaws is provided with one or more locking pins, said locking pins being movable radially with respect to the rotation axis, and where the self-tailing cover is provided with radially extending cams said cams having a varying radial curvature with respect to the rotation axis, and where the cams by rotating the self-tailing cover into a first position can urge the engaging pins radially outward and into the indentations, thereby locking the jaws and drum together, and in another position can allow the engaging pins to be free of the indentations, thereby allowing the jaws to rotate freely with respect to the drum.

By manipulating the locking pins into and out of engagement with the indentations provided on the surface of the jaws it is possible to control the coupling between the jaws and the drum and thereby control when the tension created by the drum being rotated and the rope being held by the jaws shall be creating tension in the rope or by disengaging the engagement between the locking pins and the jaws allowing the jaws to lessen the tension on the drum thereby easing off rope from the winch.

In a further advantageous alternative embodiment the self-tailing jaws are provided with a surface facing towards the rotation axis around which the drum and jaws rotate, and where indentations are provided in said surface, and where the drum on a part of the drum being covered by the self-tailing jaws is provided with one or more balls, held such that a diameter of the balls extends on either side of the balls holding means, said balls being movable radially with respect to the rotation axis, and where the self-tailing cover is provided with radially extending cams said cams having a varying radial curvature with respect to the rotation axis, and that the cams by rotating the self-tailing cover into a first position can urge the balls radially outward and into the indentations, thereby locking the jaws and drum together, and in another position can allow the balls to be free of the indentations, thereby allowing the jaws to rotate freely with respect to the drum.

In this embodiment the balls have replaced the locking pins, but will operate in exact same manner When the cam is not urging the balls outwards into the indentations the jaws will be able to rotate independently of the drum, whereas when the cam urges the balls outwards the jaws and the drum will be in locked relationship such that they will rotate together.

In a still further alternative embodiment the self-tailing jaws are provided with a surface facing towards the rotation axis around which the drum and jaws rotate, and where indentations are provided in said surface, and where the drum on a part of the drum being covered by the self-tailing jaws is provided with one or more locking pawls, said pawls being rotatable with respect to the rotation axis parallel to the axis around which the drum rotates, and where the self-tailing cover is provided with radially extending cams said cams having a varying radial curvature with respect to the rotation axis of the drum, and where the cams by rotating the self-tailing cover into a first position pivot the pawls, such that a part of the pawls is introduced into the indentations, thereby locking the jaws and drum together, and in another position the cams can allow the pawls to rotate free of the indentations, thereby allowing the jaws to rotate freely with respect to the drum.

Traditionally winches of this type are provided with pawls in order to hinder rotation of the drum in one direction and allow the drum to rotate in the opposite direction. In this embodiment a similar construction is used in order to allow the jaws to rotate freely relative to the drum when the pawls are in a non-engaged position, and by rotating the self-tailer's cover, the pawls are activated and rotate into the indentations, thereby locking the jaws to the drum.

In a still further advantageous alternative embodiment of the invention the top part of the drum has a flange which flange extends above the jaws, and radially over the jaws with respect to the drum's rotation axis, where a number of holes having a through-going axis parallel to the rotation axis of the drum is provided substantially evenly distributed in said flange, said holes being superposed a part of the jaws, and where in an upper surface of the jaws a plurality of blind holes are provided, having an axis parallel to the drum's axis of rotation, and where biased locking pins are provided in said blind holes, such that the locking pins when not influenced by a force extend partly above the upper surface of the jaws and partly into a hole in the flange, and where the diameter of the locking pins is smaller than the diameter of the holes, and where the self-tailing cover on its underside is provided with a plurality of projections, which projections may be inserted in one or more of the plurality of holes in the flange, thereby urging the locking pin out of the hole, releasing the coupling between the flange and the jaws.

The top part of the drum may be integrally formed with the drum, or may be a separate part, for example bolted or welded on to the drum in an upper part of the drum.

In this embodiment the self-tailing cover can be depressed whereby the projections push the locking pins back in the blind holes in the jaws. The projections of course are dimensioned such that the distal ends of the projections when depressed are flush with the underside of the flange. Therefore the jaws are de-coupled from the drum, and the jaws may rotate independently of the drum. Naturally, the number of projections projecting from the self-tailing cover is less or the same as the number of holes in the flange, and the number of locking pins corresponds to the number of projections. In this manner it is assured that the self-tailing cover may be depressed when a projection is superposed a hole. If there were more projections, the projections not being superposed a whole would be stopped by the flange, and the de-coupling would not be possible.

In a further advantageous embodiment the self-tailing jaws are provided with means between the drum and the self-tailing cover urging the self-tailing cover into a position where the pins or balls are extending into the indentations, and the cams on the self-tailing cover, locks the pins or balls into engagement with the drum, and where this engagement between the pins or balls and the indentations is unlocked by a user urging the self-tailing cover against the means urging the self-tailing cover into the locking position.

In this manner it becomes very easy for a user to operate the winch simply by gripping the top part of the winch construction being constituted by the winch cover and in this manner easily and safely control whether or not the coupling between the self-tailing device and the drum is engaged or disengaged.

In order to control this action the invention in a further advantageous embodiment the indentations in a radial direction has the shape as part of a circle, and where two adjacent indentations create a point pointing towards the axis of rotation, where the distance from the point to the axis is shorter that the distance from the furthest point in the indentation to the axis.

By creating the points between adjacent indentations it is ensured that the pins when being operated by the means for engaging the pins into the indentations are not coming to rest on a surface between adjacent indentations and as such the point will ensure that the pins or balls will always slide down into the indentation and thereby into the operating position.

In a further embodiment of the invention a self-tailer arm is provided outside the diameter of the jaws, said self-tailer arm suitable to guide a rope, sheet or halyard from the drum and into the jaws.

In a further advantageous embodiment of the invention the self-tailing jaws are urged towards each other by resilient means and able to engage a rope, sheet or halyard inserted into the opening between the jaws.

With this arrangement it is possible to accommodate different rope diameters between the self-tailing jaws and as such the entire winch construction becomes more versatile.

Also depending on the tension in the rope, the rope will be able to work towards the axis of the drum thereby being increasingly caught in the grip between the two jaws. The jaws may be provided with radial ribs which will further improve the engagement between the rope and the jaws.

In a further advantageous embodiment of the invention a winch handle is provided, which winch handle may be inserted in an engagement opening in the top of the self-tailing winch, which engagement opening is in connection with appropriate gears for driving the drum when the handle is being rotated, where said winch handle further comprises a lever, which lever can be brought from a storage position to an engagement position, where when the winch handle is inserted into the engagement opening, the lever may be brought into an engagement position where a distal end of the lever engages the self-tailing cover such that the self-tailing cover is manipulated by manipulating the winch handle.

Particularly in busy/stressful situations on a sailboat it is advantageous to be able to trim the sails without removing the handle. The trim may have to be adjusted back and forth rather quickly especially when racing, or when short-hand sailing and as such by providing a mechanism where the handle is provided with a lever which can engage the release mechanism in/on the self-tailing cover, it is not necessary to remove the handle while trimming. Everything can be carried out by one person quickly and reliably.

The invention is also directed to a method of operating the novel and inventive self-tailing winch with a release function as described above where the method is directed to operation of a self-tailing winch with a release function in order to either tighten or loosen a rope, sheet or halyard where the winch comprises:

a stator body adapted to be fastened on a surface;

a drum body arranged concentrically and rotatable around said stator body, where a mechanism is provided for allowing the drum body only to rotate in one direction;

a self-tailing device arranged concentrically to said drum body, where said self-tailing device comprises:

- two self-tailing jaws defining an opening suitable to receive a rope, sheet or halyard;
- a self-tailing cover which is rotatable relative to the drum body and the self-tailing jaws;
- a releasable coupling arranged between the self-tailing cover and the self-tailing jaws, said coupling being able to couple the self-tailing jaws to the drum body and by manipulating the self-tailing cover releasing the self-tailing jaws from the drum body, allowing the self-tailing jaws to rotate relative to the drum, where the rope, sheet or halyard to be handled is wound around the outside of the drum, and guided into the opening between the self-tailing jaws such that the rope, sheet or halyard may be tightened by rotating the drum, and locked by the jaws, and by manipulating the releasable coupling the jaws are liberated from their engagement with the drum, and allowed to rotate against the rotation direction of the drum, thereby letting rope, sheet or halyard feed out from the self-tailing winch.

It is clear that the method utilizes the inventive features of the self-tailing winch as such and thereby enjoys the same advantages.

DESCRIPTION OF THE DRAWING

The invention will now be described with reference to the accompanying drawings wherein.

DETAILED DESCRIPTION OF THE INVENTION

Figure 1:
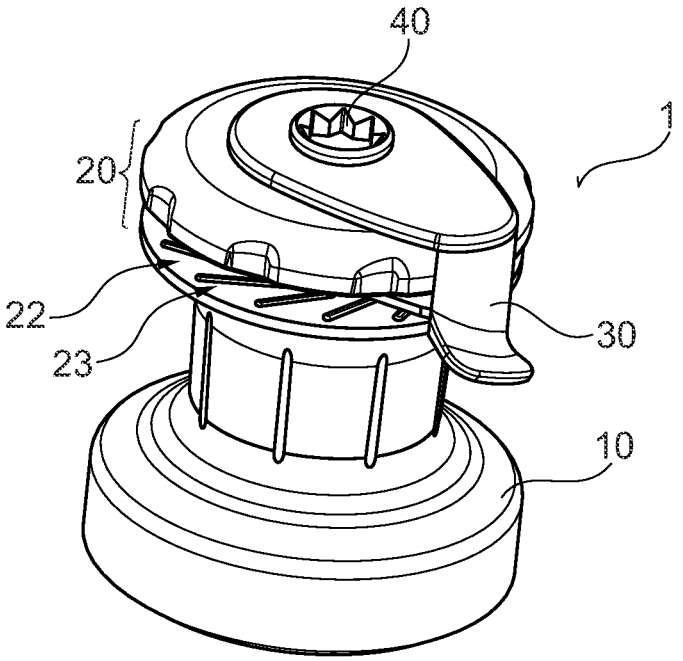
FIG. 1 illustrates a self-tailing winch with a release function

In FIG. 1 is illustrated a self-tailing winch with a release function according to the present invention. The self-tailing winch 1 comprises a drum 10, a self-tailing device 20, a self-tailing arm 30 and an aperture 40 suitable to receive a handle for manual operation of the self-tailing winch 1.

Winches of this type typically used on sail boats may either be purely manual, i.e. a handle needs to be inserted into the aperture 40 and rotated in order to rotate the drum. Inside the winch 1 is arranged a stator which stator is usually fastened to a surface such as for example coamings, deckhouse or the deck on a sailboat and at a lower portion of the stator is arranged a gear mechanism which by means of gear wheels and spindles translates the rotating action of the handle inserted into the aperture 40 into a mechanical motion rotating the drum 10. The lower bulging portion of the drum 10 usually covers the gear mechanism as well as the foot of the stator suitable to be fastened to a surface. Further it guides the rope around the drum.

Alternatively, and increasingly common, the winch is operated by electrical means such that the gear mechanism is connected to an electrical motor such that by pushing an activation button the drum may be rotated in order to tension a rope.

In this description the winch is described as being suitable to tension a rope, sheet, halyard or wire, but for ease of reading reference will be made to a rope in the ensuing detailed description. However, it is clear to the person skilled in the art that these types of winches are suitable for use with at least all of the above-mentioned.

Figure 2:
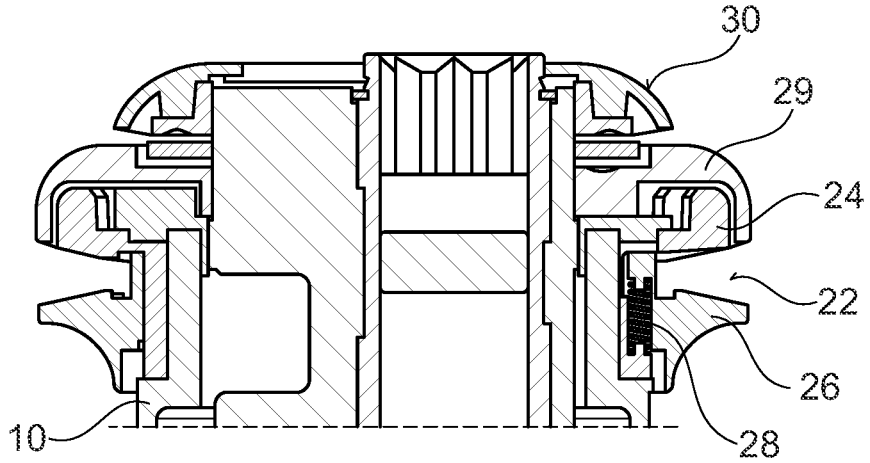
FIG. 2 illustrates a cross-section of the self-tailing device

In operation the winch 1 is used by guiding a rope a number of times around the body of the drum 10 before using the self-tailing arm 30 to guide the rope from the drum onto the self-tailing device 20. The self-tailing device comprises as is illustrated with reference to the cross-section of the self-tailing device illustrated in FIG. 2 a rope receiving groove 22. The groove is delimited by upper and lower jaws 24, 26 which by means of a spring 28 are urged towards each other and against the rope.

Therefore, when inserting a rope into the groove 22 the distance between the jaws 24 and 26 will increase a small amount in order to establish a firm grip with the rope inserted into the groove 22. This grip may be further enhanced by providing ribs 23 inside the groove 22 as illustrated in FIG. 1. As the drum is rotated, for example by inserting a handle into the aperture 40 and activating the gears by rotating the handle as discussed above the jaws will grip the rope and create tension such that the rope arranged a number of times around the outer surface of the drum will likewise be tensioned thereby transferring the tension to the rope in order to tension the rope, for example connected to a sail.

Figure 3:
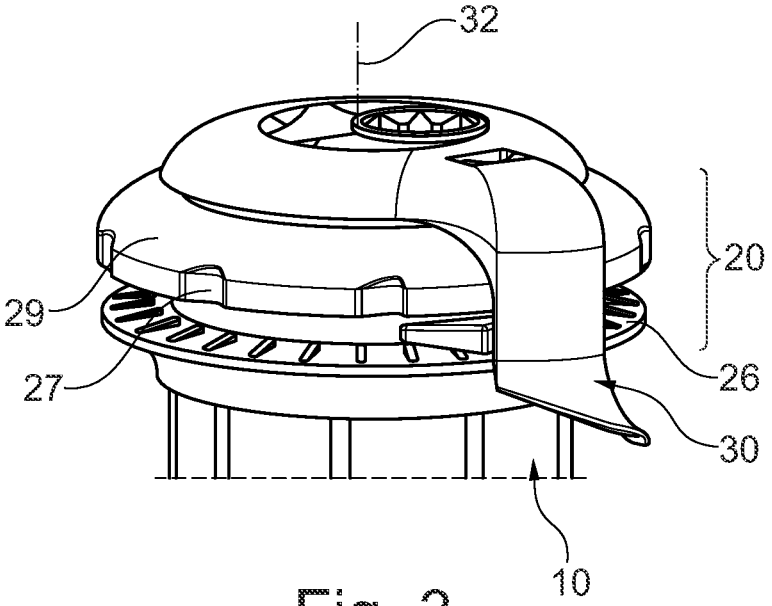
FIG. 3 illustrates 3 the top section of the winch

In FIG. 3 the top section of the winch is illustrated. The top section includes the self-tailing device 20. In this view illustrated in FIG. 3 the uppermost jaw 24 is hidden by a self-tailing cover 29. In this embodiment the cover is provided with slight indentations 27 such that it is easy to grip and manipulate by a user. The self-tailing cover is as should be explained above used to manipulate the release function of the self-tailing winch and as such shall be readily available and accessible to persons using the winch.

Figure 4:
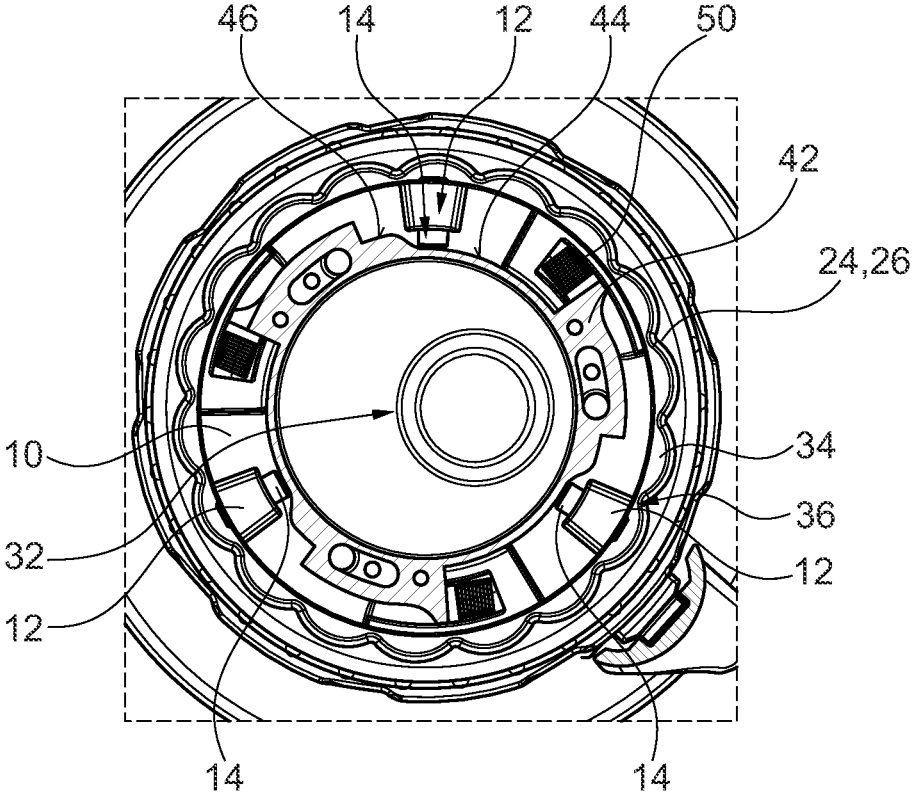
FIG. 4 illustrates a cross-section taken perpendicular to the axis of rotation
Figure 5:
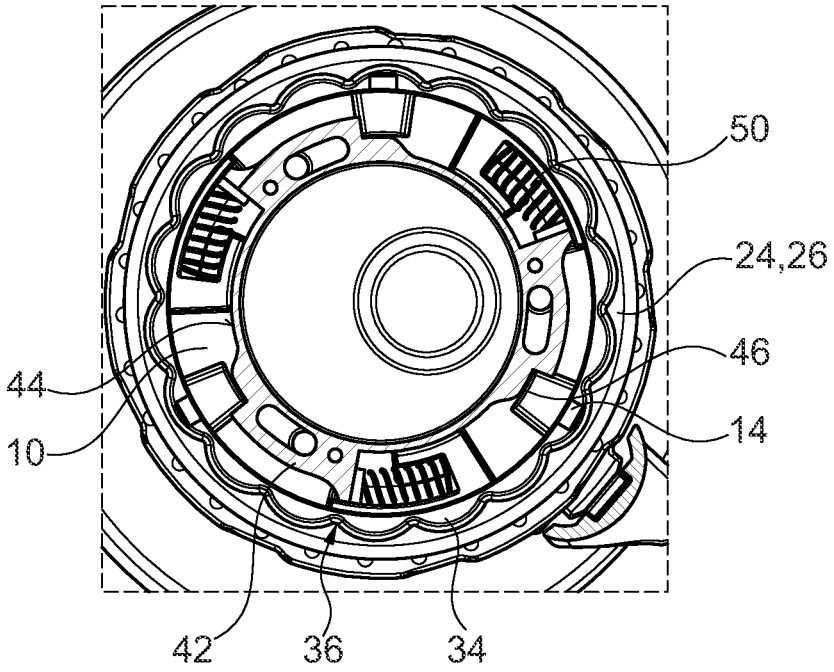
FIG. 5 illustrates a cross-section taken perpendicular to the axis of rotation

FIG. 4 and FIG. 5 illustrate cross-sections taken perpendicular to the axis of rotation illustrated by the dashed line 32. The cross-sections are furthermore situated through the self-tailing cover such that it is possible to see the construction of the releasable coupling arranged between the self-tailing cover and the self-tailing jaws.

In FIG. 4 is illustrated a cross-section illustrating a situation where the jaws 24, 26 are free to rotate relative to the drum 10. The jaws 24, 26 are provided on a side facing the axis of rotation with plurality of indentations 34. The shape of the indentations is in this embodiment in the shape of parts of circles where adjacent indentations form a point 36 such that the point 36 is closer to the axis of rotation 32 than the bottom of the indentation 34. As is evident from the cross-section in FIG. 2 the jaws 24, 26 are arranged at least partially outside the drum 10.

Turning back to FIG. 4 the jaws 24, 26 encircle the drum 10. In the top of the drum 10 are provided housings 12 which housings in this embodiment accommodate a number of locking pins 14. In this embodiment three housings are provided with three locking pins evenly distributed along the circumference at the top of the drum 10. The locking pins 14 are radially movable within the housing 12 relative to the axis of rotation 32. Any number of housings/pins may be arranged around the periphery.

The self-tailing cover has a part projecting downwards onto the top of the drum 10 such that this part 42 as illustrated by the hatched section has a number of sections. A first curved section 44 where the diameter from the axis of rotation 32 to the surface 44 is such that the surface does not engage the locking pin 14. The downwards projecting part 42 of the cover has a second curvature with a larger diameter from this second curvature 46 to the axis of rotation 32 which may come into contact with the locking pins 14 and thereby radially displace the locking pins into the indentations 34 as will be explained with reference to FIG. 5. When the locking pins 14 are fully displaced the drum will be locked to the jaws.

The downwards projecting part 42 is biased by means of a spring 50 such that a biasing force is established between the top of the drum 10 and the downwards projecting part 42 of the cover.

Turning to FIG. 5 like features are provided with like reference numbers.

In this position the self-tailing cover has been manually released such that spring forces have been released as well. Consequently, the springs 50 are enlarged. This in turn rotates the self-tailing cover such that the second cam surface 46 engages the locking pins 14 and forces these radially outwards and into the indentations 34. In this position the locking pins 14 ensures that there is a firm coupling between the jaws 24, 26 and the top of the drum such that the self-tailing winch may be used in its normal way, i.e. for tensioning a rope where the rope has been wound several times around the drum 10 and inserted into the groove 22 in the self-tailing device.

When it is desirable to ease off rope from the winch the self-tailing cover 29 is manipulated whereby the downwards projecting part of the cover moves against the springs 50 and allows the locking pins to be moved radially inwards towards the first cam surface 44. The locking pins 14 are being urged radially inwards due to the design of the indentation, i.e. the locking pins 14 will slide along the surface of the indentations 34 until they reach the point 36 adjoining adjacent indentations 34. At this point 36 the jaws 24, 26 are able to rotate free of the engagement from the locking pins and thereby also free with respect to the drum.

Therefore, by manipulating the self-tailing cover 29 and thereby the downwards projecting part 42 it is possible for a user to manipulate the locking pins into or out of engagement with the jaws such that coupling or decoupling may be achieved between the jaws and the drum.

Figure 6:
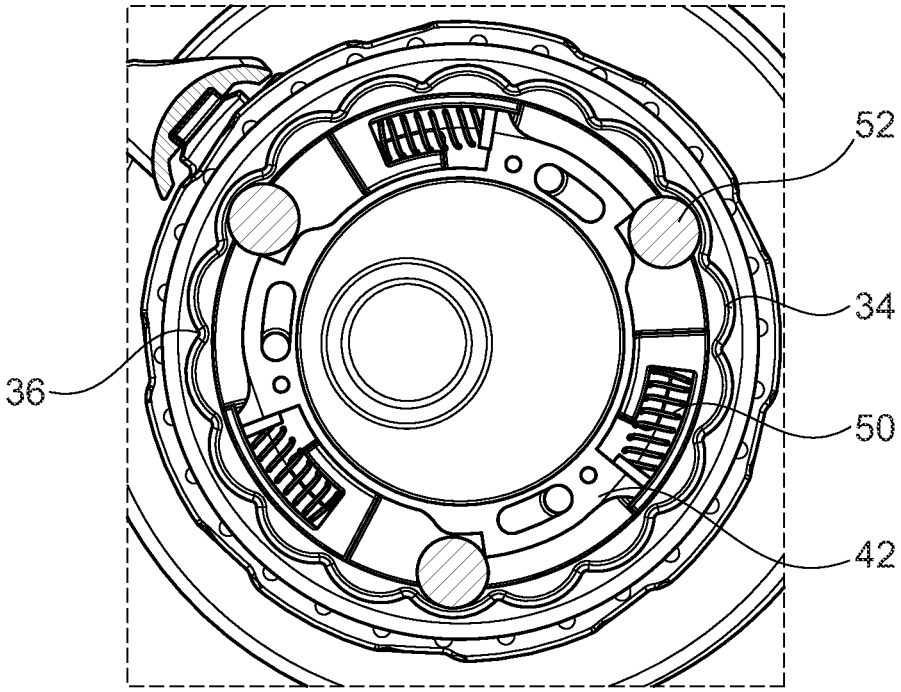
FIG. 6 illustrates an analogous embodiment where the locking pins are replaced by balls
Figure 7:
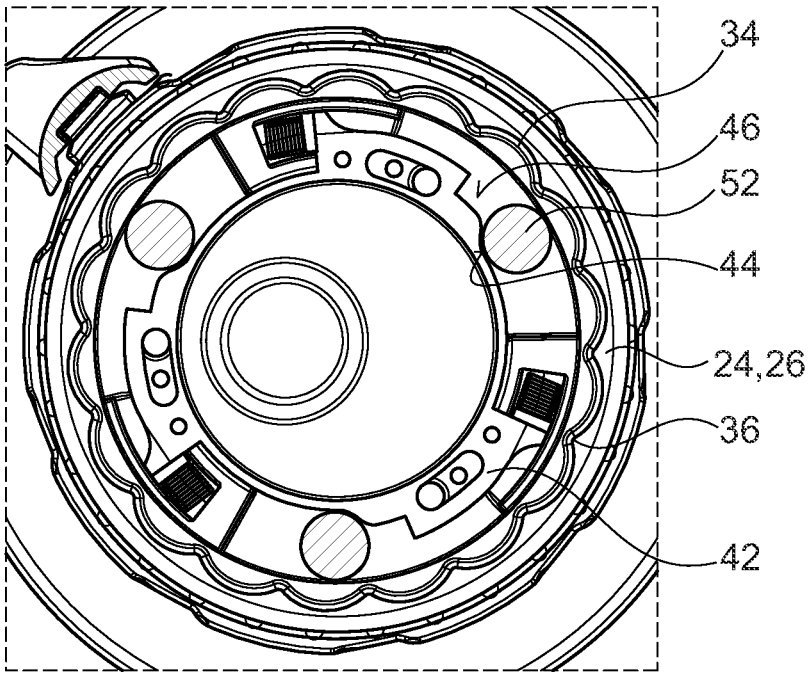
FIG. 7 illustrates an analogous embodiment where the locking pins are replaced by balls

In FIGS. 6 and 7 are illustrated an analogous embodiment where the locking pins described above with reference to FIGS. 4 and 5 are replaced by balls 52. The embodiment illustrated in FIGS. 6 and 7 functions in the exact same manner as the embodiments in FIGS. 4 and 5 and therefore FIG. 6 fully corresponds to an embodiment where the balls have engaged the jaws 24, 26 corresponding to the description with reference to FIG. 5.

Also FIG. 7 corresponds to a situation where the self-tailing cover 29 has been manipulated thereby compressing the springs 50 allowing the balls to move radially inwards towards the first cam surface thereby coming out of contact with the indentations provided in the jaws 24, 26.

Figure 8:
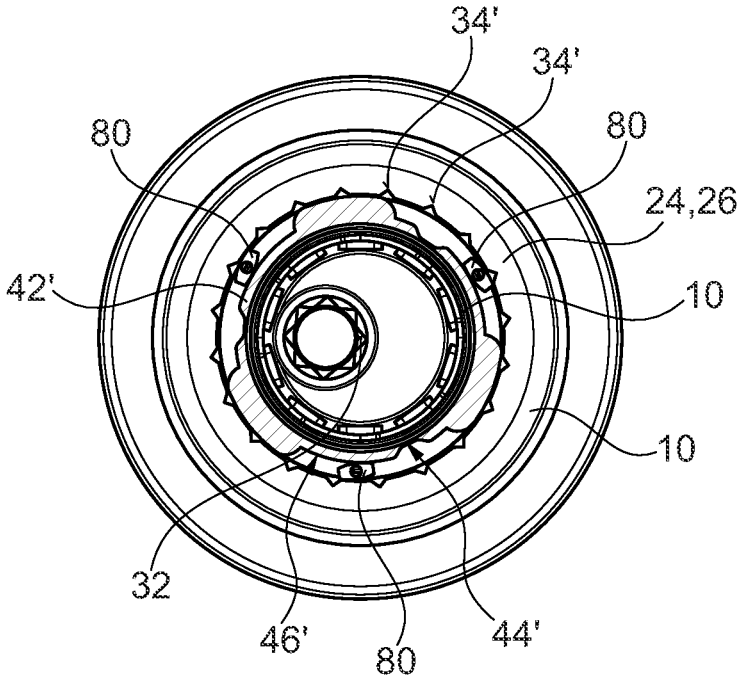
FIGS. 8 and 9 illustrate an embodiment where the coupling mechanism includes pawls
Figure 9:
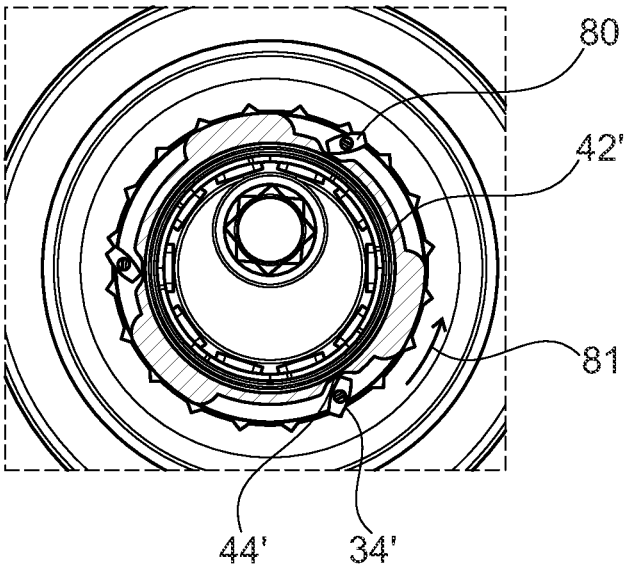

In FIGS. 8 and 9 is illustrated an embodiment where the coupling mechanism includes pawls which are activated in order to either lock the jaws to the drum or in an unlocked position allow the jaws to rotate freely relative to the drum.

Both FIGS. 8 and 9 are cross-sections through a top part of a self-tailing winch in order to illustrate the construction of the releasable coupling.

In FIG. 8 is illustrated a situation where the jaws 24, 26 are free to rotate with respect to the drum 10. On an inner surface of the jaws 24, 26 arranged towards the axis of rotation 32 of the winch is provided a number of indentations 34'. On a downwards projecting part of the self-tailing cover 42' is provided radially extending cams 44', 46' where the cams 44', 46' have varying radial curvature such that a radius to the further point from the rotation axis 32 to a radial cam surface 46' is larger than the radial distance from the rotation axis 32 to the cam surface 44'.

Between the inner surface of the jaws provided with the indentations 34' and the cams 44', 46' are arranged a number of pawls 80. In the illustrated embodiment three pawls are arranged substantially evenly distributed along the circumference of the surface with the indentations 34'. Each pawl 80 is arranged such that it may rotate around an axis. In the embodiment illustrated in FIG. 8 it is clear that the cam surface 46' is in contact with a side of the pawl 80 such that no part of the pawl extends beyond the surface with the indentations 34' and consequently does not engage the indentations 34'.

However, turning to FIG. 9 the self-tailing cover 42' extending downwards has been rotated such that the pawls 80 are arranged next to the cam surface 44' whereby it becomes possible for the pawl 80 to rotate and engage an indentation 34'. In this position it will not be possible to rotate the jaws in the direction indicated by the arrow 81 without the drum moving in the same direction. Due to the construction with the pawls it will be possible to rotate the jaws relative to the drum in a direction opposite to the direction indicated by the arrow 81.

Figure 10:
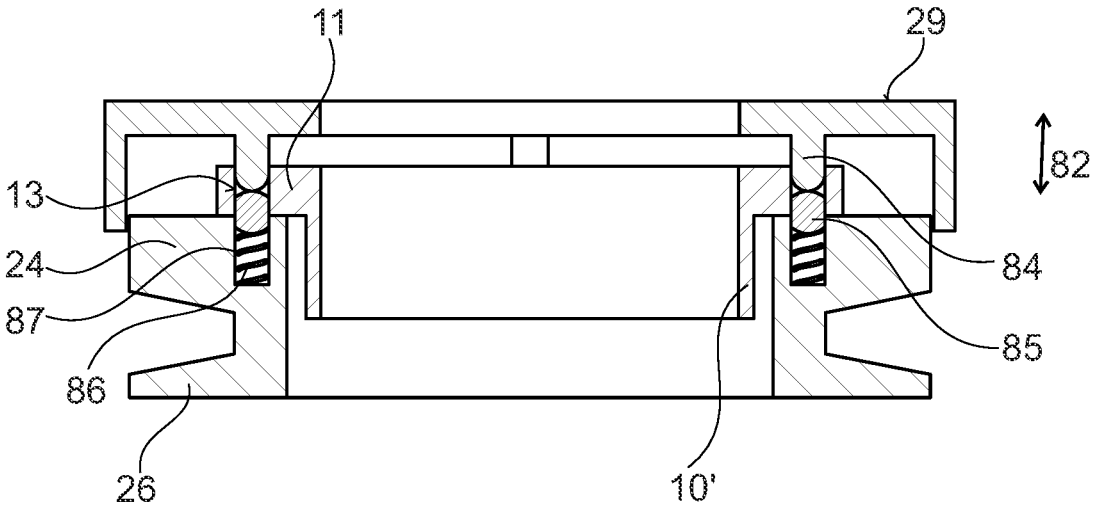
FIG. 10 illustrates an alternative embodiment with a push-button mechanism

In a further embodiment illustrated in FIG. 10 an alternative embodiment is illustrated where the self-tailing cover 29 is movable in a direction as indicated by the arrow 82, i.e. in normal use vertically up and down. On the underside of the self-tailing cover 29 are provided a number of projections 84. Each projection has an extent from the underside of the self-tailing cover 29 such that it will be able to push a locking pin 85 against a spring 86 arranged in a blind hole 87. The top of the drum 10' is provided with a flange 11 which flange extends radially from the drum 10' and over at least part of the jaws 24, 26. In the flange is provided a plurality of holes 13 where the diameter of the holes 13 is such that they are able to accommodate the projections 84 and also the locking pins 85.

In the situation illustrated in FIG. 10 the self-tailing cover 29 has not been depressed which means that the locking pins 85 are elevated or urged upwards by the spring 86 such that part of the locking pin 85 is situated inside the hole 13 provided in the flange 11 and part of the locking pin is situated in the blind hole 87 provided in the jaws. Consequently, the drum 10' and the jaws 24, 26 are locked together due to the provision of the locking pins 85.

By forcing the self-tailing cover 29 downwards in the direction indicated by the arrow 82 the projections 84 will push the locking pins 85 down into the blind holes 87 thereby compressing the springs 86. The projections 84 are dimensioned such that when the self-tailing cover is depressed, the projections will have a distal part which when depressed is flush with the underside of the flange 11 whereby the locking pins will be completely disengaged from the hole provided in the flange 11. Thereby the jaws 24, 26 are decoupled from the flange and thereby the drum 10', whereby the jaws 24, 26 will be able to rotate freely with respect to the flange 11 and thereby also the drum 10'.

Figure 11:
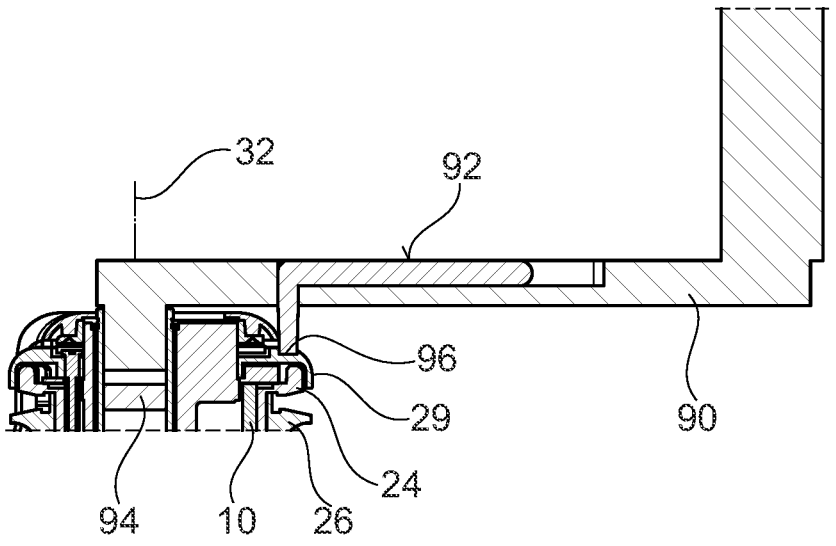
FIG. 11 illustrates an embodiment where a winch handle is used to control the winch.

Turning to FIG. 11 a solution is disclosed for manipulating the self-tailing cover 29 by means of a handle 90. As already discussed above winches particularly on sailboats may either be operated manually or be operated by electrical means. Particularly for race applications it is desirable to operate them manually since the operation may be carried out much faster which is an important aspect of racing.

A winch handle 90 is therefore inserted in an engagement opening 94 which is in contact with gears connected to the drum such that by rotating the handle 90 around the rotation axis 32 the drum is made to rotate.

If or when it becomes desirable to ease off rope from the drum by activating one of the mechanisms discussed above, a lever 92 arranged in the handle 90 may be displaced such that it comes into contact with the self-tailing cover 29 as illustrated in FIG. 11. The distal end 96 of the lever 92 is as illustrated, in engagement with the self-tailing cover and by further rotating the handle 90 it is possible to manipulate the self-tailing cover 29 and thereby release the jaws 24, 26 from their engagement with a drum 10 as described above.

With this construction the handle 90 may be removed from the engagement opening 94 which is traditional in the technical field.

Considering that a self-tailing winch with a release function will not be immediately recognisable to a new user of the winch, it is considered an advantage to have the release mechanism locked out so that the first time the winch is used the release mechanism will only be operable to a knowledgeable user that has read the instructions regarding the working of the release mechanism, safety aspects to be aware of, and has removed the lock-out feature to enable the release mechanism. A preferred lock out mechanism may be a screw (or screws) that lock the self-tailer cover from being manipulated. By removing the locking screws, the user must have read the instructions and is aware of the safety implications, and is ready to use the self-tailing winch and the release mechanism.

If a user is unaware of the release mechanism, the lock remains in place and the winch may used as a common self-tailing winch, until the user consciously removes the lock(s).

The invention claimed is:

1. Self-tailing winch with a release function, where said winch comprises:

a stator body adapted to be fastened on a surface;

a drum body arranged concentrically and rotatable around said stator body;

a self-tailing device arranged concentrically to said drum body, where said self-tailing device comprises:

two self-tailing jaws defining an opening suitable to receive a rope, sheet or halyard;

a self-tailing cover which is rotatable relative to the drum body and the self-tailing jaws;

a releasable coupling arranged between the self-tailing cover and the self-tailing jaws, said coupling being able to couple the self-tailing jaws to the drum body and by manipulating the self-tailing cover completely releasing the self-tailing jaws from their engagement with the drum body, allowing the self-tailing jaws to rotate relative to the drum.

2. Self-tailing winch according to claim 1, wherein the self-tailing jaws are provided with a surface facing towards a rotation axis around which the drum and jaws rotate, and where indentations are provided in said surface, and where the drum on a part of the drum being covered by the self-tailing jaws is provided with one or more locking pins, said locking pins being movable radially with respect to the rotation axis, and where the self-tailing cover is provided with radially extending cams said cams having a varying radial curvature with respect to the rotation axis, and that the cams by rotating the self-tailing cover into a first position can urge the locking pins radially outward and into the indentations, thereby locking the jaws and drum together, and in another position can allow the locking pins to be free of the indentations, thereby allowing the jaws to rotate freely with respect to the drum.

3. Self-tailing winch according to claim 2, wherein means are provided between the drum and the self-tailing cover urging the self-tailing cover into a position where the pins, are extending into the indentations, and the cams on the self-tailing cover, locks the pins into engagement with the drum, and where this engagement between the pins and the indentations is unlocked by a user urging the self-tailing cover against the means urging the self-tailing cover into the locking position.

4. Self-tailing winch according to claim 2 wherein the indentations in a radial direction have the shape as part of a circle, and that two adjacent indentations create a point pointing towards the axis of rotation, where the distance from the point to the axis is shorter than the distance from the furthest point in the indentation to the axis.

5. Self-tailing winch according to claim 1, wherein the self-tailing jaws are provided with a surface facing towards a rotation axis around which the drum and jaws rotate, and where indentations are provided in said surface, and where the drum on a part of the drum being covered by the self-tailing jaws is provided with one or more balls, held such that a diameter of the balls extends on either side of balls holding means, said balls being movable radially with respect to the rotation axis, and where the self-tailing cover is provided with radially extending cams said cams having a varying radial curvature with respect to the rotation axis, and that the cams by rotating the self-tailing cover into a first position can urge the balls radially outward and into the indentations, thereby locking the jaws and drum together, and in another position can allow the balls to be free of the indentations, thereby allowing the jaws to rotate freely with respect to the drum.

6. Self-tailing winch according to claim 5 wherein means are provided between the drum and the self-tailing cover urging the self-tailing cover into a position where the balls are extending into the indentations, and the cams on the self-tailing cover, locks the balls into engagement with the drum, and where this engagement between the balls and the indentations is unlocked by a user urging the self-tailing cover against the means urging the self-tailing cover into the locking position.

7. Self-tailing winch according to claim 1, wherein the self-tailing jaws are provided with a surface facing towards a rotation axis around which the drum and jaws rotate, and where indentations are provided in said surface, and where the drum on a part of the drum being covered by the self-tailing jaws is provided with one or more locking pawls, said pawls being rotatable with respect to the rotation axis parallel to the axis around which the drum rotates, and where the self-tailing cover is provided with radially extending cams said cams having a varying radial curvature with respect to the rotation axis of the drum, and where the cams by rotating the self-tailing cover into a first position pivots the pawls, such that a part of the pawls is introduced into the indentations, thereby locking the jaws and drum together, and in another position the cams can allow the pawls to rotate free of the indentations, thereby allowing the jaws to rotate freely with respect to the drum.

8. Self-tailing winch according to claim 7 wherein means are provided between the drum and the self-tailing cover urging the self-tailing cover into a position where the pawls are extending into the indentations, and the cams on the self-tailing cover, locks the pawls into engagement with the drum, and where this engagement between the pawls and the indentations is unlocked by a user urging the self-tailing cover against the means urging the self-tailing cover into the locking position.

9. Self-tailing winch according to claim 1, wherein a top part of the drum has a flange which flange extends above the jaws, and radially over the jaws with respect to a rotation axis around which the drum and jaws rotate, and where a number of holes having a through-going axis parallel to the rotation axis of the drum is provided substantially evenly distributed in said flange, said holes being superposed vertically over the jaws, and where in an upper surface of the jaws a plurality of blind holes are provided, having an axis parallel to the drum's axis of rotation, and where biased locking pins are provided in said blind holes, such that the locking pins when not influenced by a force extend partly above the upper surface of the jaws and partly into a hole in the flange, and where the diameter of the locking pins is smaller than the diameter of the holes, and where the self-tailing cover on its underside is provided with a plurality of projections, which projections may be inserted in one or more of the plurality of holes in the flange, thereby urging the locking pin out of the hole, releasing the coupling between the flange and the jaws.

10. Self-tailing winch according to claim 9, wherein the number of projections projecting from the self-tailing cover is less or the same as the number of holes in the flange, and where the number of locking pins corresponds to the number of projections.

11. Self-tailing winch according to claim 1, wherein a self-tailer arm is provided outside the diameter of the jaws, said self-tailer arm being suitable to guide a rope, sheet or halyard from the drum and into the jaws.

12. Self-tailing winch according to claim 1, wherein a winch handle is provided, which winch handle may be inserted in an engagement opening in the top of the self-tailing winch, which engagement opening is in connection with gears for driving the drum when the handle is being rotated, where said winch handle further comprises a lever, which lever can be brought from a storage position to an engagement position, where when the winch handle is inserted into the engagement opening, the lever may be brought into an engagement position where a distal end of the lever engages the self-tailing cover such that the self-tailing cover is manipulated by manipulating the winch handle.

13. Self-tailing winch according to claim 1, wherein said self-tailing jaws are urged towards each other by resilient means and able to engage a rope, sheet or halyard inserted into the opening between the jaws.

14. Self-tailing winch according to claim 1, wherein a lock-out feature is provided, in the shape of one or more screws, which one or more screws when installed is locking the self-tailer cover to the drum, and when the one or more screws are removed allowing the self-tailing cover to be manipulated relative to the drum.

15. Method of operating a self-tailing winch with a release function in order to either tighten or loosen a rope, sheet or halyard where the winch comprises:

a stator body adapted to be fastened on a surface;

a drum body arranged concentrically and rotatable around said stator body, where a mechanism is provided for allowing the drum body only to rotate in one direction;

a self-tailing device arranged concentrically to said drum body, where said self-tailing device comprises:

two self-tailing jaws defining an opening suitable to receive a rope, sheet or halyard;

a self-tailing cover which is rotatable relative to the drum body and the self-tailing jaws;

a releasable coupling arranged between the self-tailing cover and the self-tailing jaws, said coupling being able to couple the self-tailing jaws to the drum body and by manipulating the self-tailing cover completely releasing the self-tailing jaws from their engagement with the drum body, allowing the self-tailing jaws to rotate relative to the drum, where the rope, sheet or halyard to be handled is wound around the outside of the drum, and guided into the opening between the self-tailing jaws such that the rope, sheet or halyard may be tightened by rotating the drum, and locked by the jaws, and by manipulating the releasable coupling the jaws are liberated from their engagement with the drum, and allowed to rotate against the rotation direction of the drum, thereby letting rope, sheet or halyard off the self- tailing winch.

* * * * *